United States Patent [19]

Verseef

[11] Patent Number: 4,727,665

[45] Date of Patent: Mar. 1, 1988

[54] HYDRAULIC ACTUATED MOLDBOARD WITH AUTOMATIC LOCK

[75] Inventor: Jan H. Verseef, Clayton, N.Y.

[73] Assignee: Frink America, Inc., Clayton, N.Y.

[21] Appl. No.: 899,019

[22] Filed: Aug. 22, 1986

[51] Int. Cl.[4] ..... E01H 5/04

[52] U.S. Cl. ..... 37/236; 172/818

[58] Field of Search ..... 37/231, 234, 236, 266, 37/279, 283; 172/812, 813, 818, 819, 820, 827, 830

[56] References Cited

U.S. PATENT DOCUMENTS

| | | | |
|---|---|---|---|
| 2,792,650 | 5/1957 | Kenyon | 37/234 |
| 3,012,345 | 12/1961 | Krueger | 172/818 X |
| 3,201,878 | 8/1965 | Markwardt | 37/231 |
| 3,432,949 | 3/1969 | Glesmann | 37/231 |
| 3,987,562 | 10/1976 | Deen et al. | 37/231 |
| 4,439,939 | 4/1984 | Blau | 37/231 |
| 4,512,494 | 8/1980 | Farrell et al. | 172/818 X |

FOREIGN PATENT DOCUMENTS

| | | | |
|---|---|---|---|
| 202588 | 3/1959 | Austria | 37/283 |

*Primary Examiner*—E. H. Eickholt

*Attorney, Agent, or Firm*—Bruns and Wall

[57] ABSTRACT

A locking mechanism for a fluid actuated snowplow which automatically locks the moldboard unit of the plow in a desired position and simultaneously therewith relieves the pressure on the fluid drive unit whereby the locking mechanism and not the drive unit accept the plowing stresses.

16 Claims, 7 Drawing Figures

2
4
80
39
10
40
16
11
12
17
18
19
21
22
23
25
27
28
31
33
50
54
56
60
62
64
65
66
67
70
72
73
74
76
77
84
86
87
88
90
91
96
98
99
100
102
103
104
106
107
109
110
111
112
117
145
146
155
157
42

HYDRAULIC ACTUATED MOLDBOARD WITH AUTOMATIC LOCK

BACKGROUND OF THE INVENTION

This invention relates to a vehicular-mounted plow for clearing snow and the like, and more particularly, to a ram actuated snowplow. The invention more specifically involves a vehicular-mounted plow having a locking mechanism which permits the plow moldboard to be selectively repositioned when necessary, and also acts to protect the ram from the stresses of plowing.

In one type of hydraulically actuated assembly, a drive frame is secured to the front of a motor vehicle and pivotably supports a moldboard unit so that it can swing from one side of the vehicle to the other. A pair of hydraulic reversing rams are mounted on either side of the frame which have extendable rods attached to the moldboard unit on either side of the pivot point. The rams are selectively controlled by an operator stationed in the cab of the vehicle to position the moldboard at a desired plowing angle. In operation one ram extends while the other retracts to set the moldboard at a desired angle. Once set, the cylinders are required to hold the moldboard in position during the plowing operation. As a consequence, plowing stresses are translated directly to the power rams which in turn, results in worn piston seals, bent drive rods and failures in other cylinder related components.

Another type of reversing mechanism that has been widely used in the industry is a worm-gear mechanism in which a sector gear is secured to a moldboard unit and is rotated by a motor driven pinion mounted on the support frame. In this type of mechanism there is no power ram, so problems such as worn piston seals and bent piston rods are avoided. However, relatively large stresses can be transmitted from the moldboard to the worm-gear and drive motor which again can cause damage to the drive mechanism.

A locking/release mechanism for a reversable plow assembly is described in U.S. Pat. No. 4,215,494. In this assembly, a ram actuated, vehicular-mounted, snowplow is disclosed having a sector plate mounted on a lifting frame and has a coacting rocker arm mounted on a rotatable drive frame. Raising the lift frame of the plow causes the rocker arm to be released from the sector plate so that the moldboard angle can be changed when the plow is raised. The rocker arm is reengaged with the sector plate when the moldboard is again lowered. This arrangement does have several advantages over the devices previously discussed, however, the operator must raise the plow prior to reversing the blade, and then must thereafter lower the plow. This involves three separate operations which is time consuming and places undue wear on the lifting mechanism.

OBJECTS AND SUMMARY OF THE INVENTION

Accordingly, it is an object of the invention to improve ram-reversible, vehicular-mounted, snowplow assemblies.

It is another object of this invention to provide such a hydraulically actuated reversible snowplow assembly for changing the blade angle of the moldboard which automatically locks the blade in the new position and which further diverts plowing stresses away from the reversing ram.

It is yet another object of this invention to provide a hydraulically actuated snowplow assembly which utilizes a power cylinder and a locking cylinder that coacts to protect the hydraulic system from the plowing stresses.

These and other objects of the present invention are attained by means of a snowplowing apparatus having a stationary support unit mounted upon the front of a motor vehicle that has a vertical pivot on the forward end thereof for rotatably supporting a moldboard unit so that the moldboard rotates in a horizontal plane to either side of the pivot. A fluid actuated power cylinder is mounted between the support and moldboard units for positioning the moldboard. The power cylinder is selectively connected to a pump to angularly position the moldboard in a desired position for plowing and to a fluid reservoir for relieving the pressure on the cylinder when the moldboard is positioned. A locking mechanism is arranged to automatically lock the moldboard to the stationary support unit when the moldboard unit is at rest and to release the moldboard unit when it is being angularly positioned by the drive means.

BRIEF DESCRIPTION OF THE DRAWING

For a better understanding of these and other objects of the present invention reference is had to the following detailed description of the invention which is to be read in conjunction with the associated drawings, wherein.

DESCRIPTION OF THE INVENTION

Figure 1:
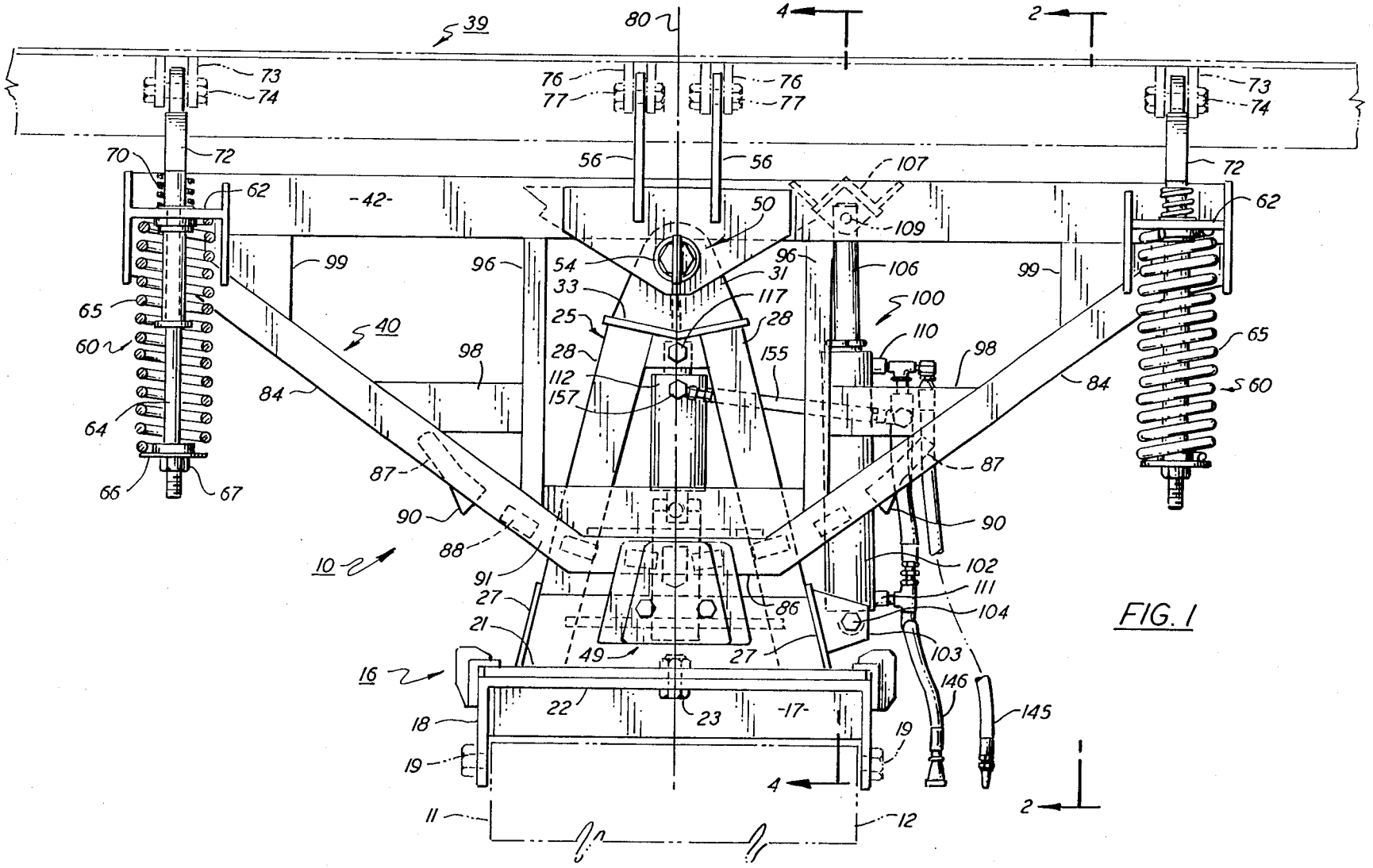
FIG. 1 is a top plan view of the reversible, vehicular-mounted snowplow assembly according to the present invention.

Referring initially to FIGS. 1–4 there is shown a vehicular mounted snowplow assembly, generally referenced 10, that embodies the teachings of the present invention. The assembly can be secured to the front end of a prime mover, such as a truck 11, in a conventional manner as described, for example, in U.S. Pat. No. 2,792,656. The truck is equipped with an upright pusher frame 12 which is secured to the chasis of the vehicle and which serves to push the snowplow assembly over a roadway or the like as the vehicle moves forward. A lifting arm (not shown) is mounted in the pusher frame and is connected to shackle unit 13 (FIG. 2), which in turn, is connected to the plow assembly via chains 14 and 15. As is well known in the art, the lifting arm is remotely controlled by an operator situated in the cab of the vehicle to raise and lower the plow assembly.

As further illustrated in FIGS. 1–4, the pusher frame is suitably coupled to a snowplow support unit 16 by means of a coupling 17. A pair of mounting bars 18—18, which are secured to the support unit, are attached to the pusher frame by a pair of horizontally aligned trunions 19—19 so that the snowplow assembly can be raised and lowered by a lifting mechanism about the pins. The connecting mechanism also contains a pair of vertically aligned bearing plates 21 and 22 that are connected by a single horizontally aligned pivot pin 23 so that the forward section of the plow assembly can oscillate about the pin 23 to accommodate change in road contour as the plow moves thereover. The support unit 16 of the plow assembly further includes a forwardly disposed A-frame unit 25 that is affixed to the front bearing plate 21. A pair of chain plates 27—27 are secured to the two converging bars 28—28 of the A-frame connects the support to the shackle as noted above via chains 14. A housing 30 is secured to the front or apex of the A-frame. The housing contains a horizontally disposed upper plate 31 and a horizontally disposed lower plate 32 that are secured to the front of the two A-frames by a V-shaped gusset 33. A vertically disposed pivot shaft 35 is contained within the housing and extends upwardly beyond the upper plate 31.

Figures 3, 4:
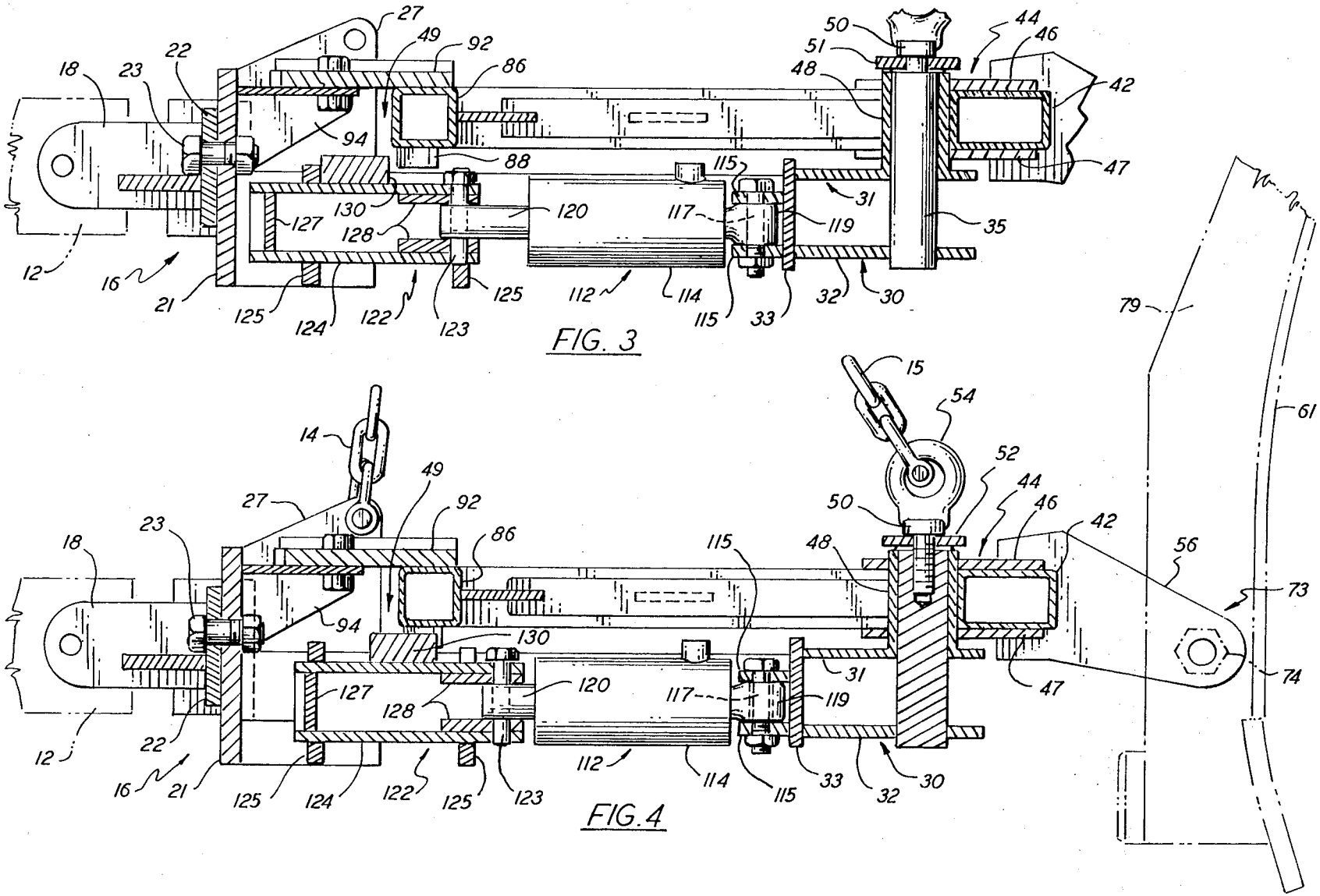
FIGS. 3 and 4 are sectional elevations taken along lines 4—4 of FIG. 1, showing the locking mechanism in a released condition and locked condition, respectively.

The moldboard unit, generally referenced 39 (FIG. 1), includes a sector frame assembly 40 which is pivotably supported upon the main support unit 16 so that the moldboard unit can be angularly positioned about a vertically disposed pivot 35 (FIGS. 3 and 4).

Figure 2:
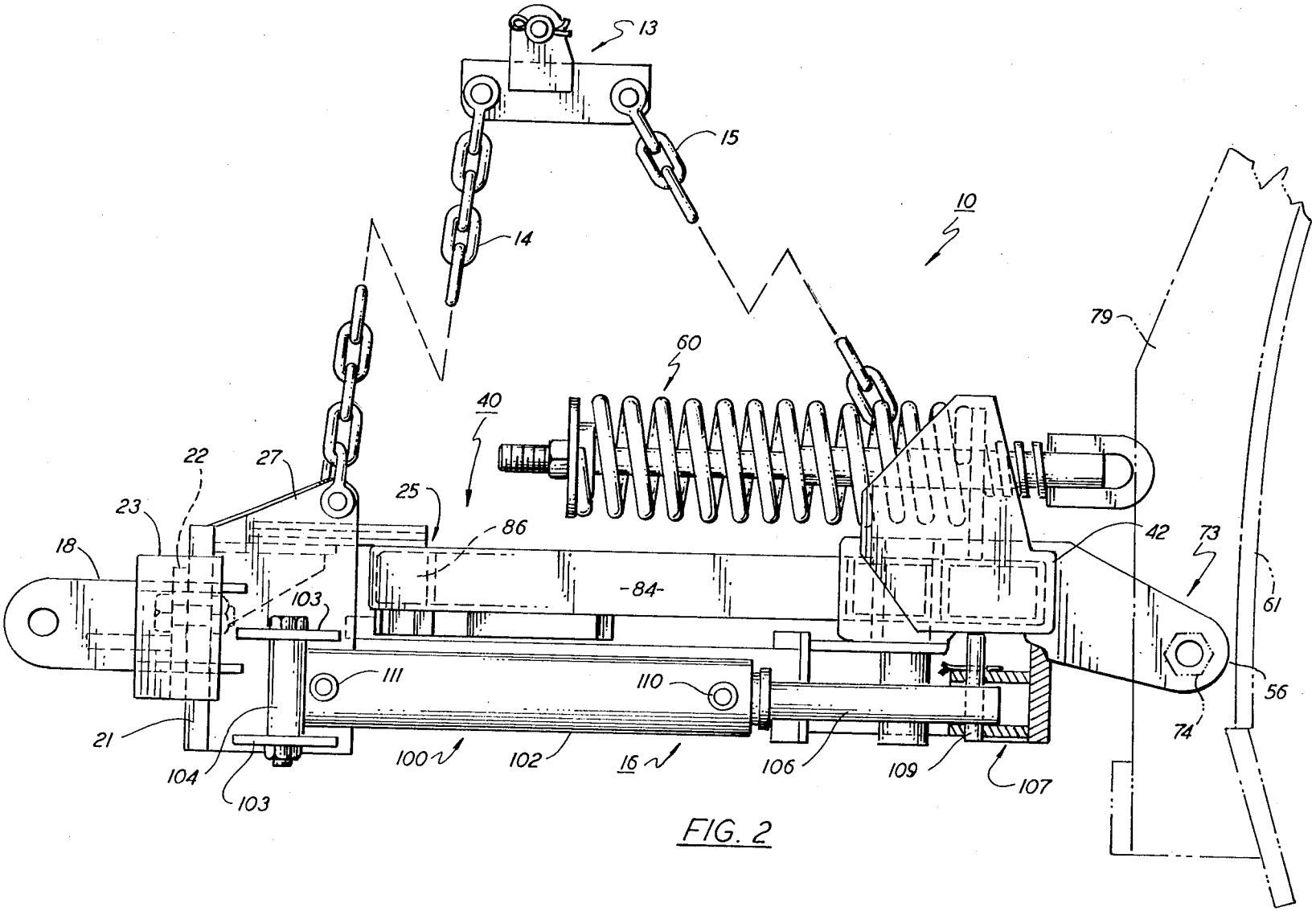
FIG. 2 is a sectional elevation taken at the line 2—2 of FIG. 1.

A sector frame unit generally referenced 40, is pivotably supported over the main support unit 16 so that it can be angularly positioned in a horizontal plane about the vertical shaft 35. The sector frame includes a main beam 42 which is preferably a rectangular tubular member. The main beam is positioned in front of the shaft 35 and extends horizontally an equal distance to either side thereof. Positioned at the center of the main beam is a bearing housing 44 formed of a top plate 46 and a bottom plate 47 (FIGS. 2 and 3). A bearing sleeve 48 is vertically supported between the plates and is adapted to slidably receive therein the top portion of the pivot shaft 35 and to provide a close running fit therebetween so that the sector frame can turn freely about the vertical shaft. A retaining bolt 50, which carries a keeper 52, is threaded into the top of the pivot shaft to retain the shaft within the bearing sleeve as illustrated in FIG. 4. The retaining bolt includes a bolt eye 54 which is attached to lifting chains 15 as illustrated in FIG. 4. Forwardly projected drive ears 56—56 are secured as by welding to frame on either side of the pivot shaft which as will be noted below engage the moldboard unit 39 to secure the unit to the pusher frame.

Although the moldboard unit may be of any suitable design as known and used in the industry, the present unit is a trip type unit having a pair of spring assemblies 60—60 which allow the section of the blade below pins 74 and 77 to be tipped rearwardly in the event the blade strikes a relatively solid object. Each spring assembly includes a spring mount 62 rigidly secured to the main beam of the sector frame and having a spring shaft 64 slidably supported therein. A heavy duty compression spring 65 is placed over the back of the shaft and is retained on the shaft by means of an end cap 66 held to the shaft by a nut 67 threaded to the end thereof. A smaller recoil spring 70 is mounted on the front of the shaft between the mount 62 and a retainer 72. The front end of each spring shaft is received in a clevis 73 located between upraiser ribs that support the blade 61. The shaft is secured to the unit by means of a clevis pin 74. The above noted drive ears 56—56 are each similarly secured to the moldboard unit by means of a clevis 76 and clevis pin assembly 77 located again in a pair of upraised moldboard support ribs 79—79.

As can be seen, as a result of this construction the moldboard unit is connected to the main beam of the sector frame and is thus adapted to move with the frame as it turns about the pivot shaft.

The sector frame further includes a pair of tubular truss members 84—84 which lie in the same plane as the main sector beam 42. Each truss member is secured as by welding to an outboard end of the main beam and slants inwardly toward the center of the frame. The back of each truss member is joined to a crossmember 86 of similar tubular configuration to close the sector frame. The sector frame, in assembly, is symmetrically positioned on the pivot shaft. A plurality of spaced apart stop lugs are disposed along an arc on the under side of the members. The lugs are located along an arc that is centered at the pivot shaft and the lugs are equally spaced along the arc to provide openings 91—91 therebetween. The lugs are symmetrically spaced on either side of the sector frame axis 80 which passes through the center of the pivot shaft 35 and bisects crossmember 86. The lugs include a pair of outside lugs 87—87 and six equally spaced inner lugs 88—88. The two outer lugs each contain rearwardly extended end stops 90—90, the function of which serve to limit the angular displacement of the sector frame and thus that of the moldboard unit. The space or opening 91 formed between adjacent lugs are of uniform width and are arranged so that a locking bar can be snugly inserted therein. The sector frame is arranged to swing in a horizontal plane through an indexing station depicted at 49.

A guide plate 92 (FIGS. 3 and 4) is bolted to the top plate of a bracket 94 located at the rear of the A-frame assembly. The guide plate is adapted to pass over the top of the cross member 86 of the sector frame and functions to hold the rear section of the frame in a horizontal plane as it turns about the pivot shaft. A pair of lateral braces 96—96 (FIG. 1) are welded between the truss members and the main frame to strengthen the sector frame and further hold the combined elements in a single plane. Gusset plates 98 and 99 are also added to the frame to increase its rigidity and provide added strength to the overall structure.

Movement of the sector frame in reference to the stationary support bracket is furnished by a double acting fluid actuated cylinder 100. The drive cylinder 100 includes an outer tube 102 having a hollow post 104 welded thereto which is rotatably supported between a pair of plates 103—103 so that the cylinder can rotate about the axis of the post. The cylinder contains a drive piston 105 (FIG. 7) that is affixed to an extendable piston rod 106. The piston rod extends forward of the cylinder and is pinned within a housing 107 affixed to the underside of the main sector beam 42 by means of pin 109 (FIG. 2). The ram is situated on the passenger's side or right hand side of the pivot shaft so that the moldboard unit is rotated to the left when the actuating rod is extended and to the right when it is retracted. The power cylinder 102 in this case is hydraulically actuated by fluid delivered from a supply system generally referenced 99 in FIG. 7. Hydraulic fluid passes in and out of the cylinder on either side of the drive piston through a forward port 110 and rear port 111 via service lines 145 and 146. (See also FIGS. 5 and 6).

Figure 7:
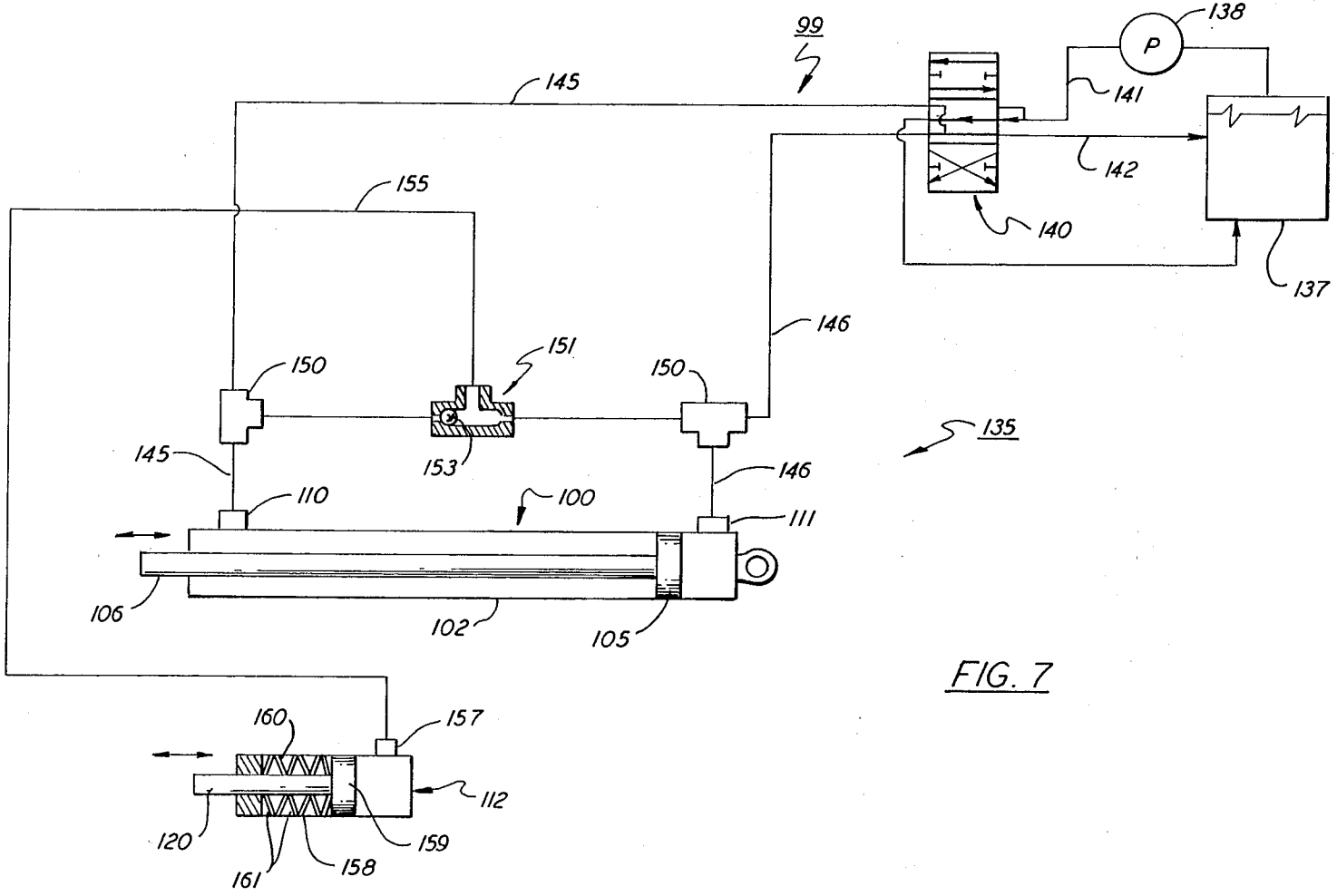
FIG. 7 is a diagram of the hydraulic system connected to the reversing cylinder and the locking cylinder used to selectively position the moldboard unit and locking it in place.

As best seen in FIG. 7, a hydraulically actuated locking mechanism 112 is located within the indexing station 49 and is arranged to act in concert with the drive cylinder to automatically lock the moldboard unit at a desired position. As best seen in FIGS. 3 and 4, the locking unit includes a locking cylinder 114 that is pivotally secured to the back of the shaft housing 30. A pair of vertically spaced apart arms 115—115 are welded to the gusset plate 33 which forms the back of the housing 30. A wrist pin 117 is passed vertically between the arms and the back of the cylinder to attach the cylinder to the support unit below the sector frame thereby permitting the frame to swing freely over the top of the support unit.

A locking bar assembly 122 extends from the front of the locking cylinder and is joined to extendable rod 120 by means of a pin 123. The locking bar assembly includes a slide member 124 that is slidably contained between guide plates 125—125. Within apertures provided therein. The slide member is a square tube that is internally strengthened by means of braces 127 and 128. A locking key 130 is welded to the top surface of the slide member and is accurately sized so that it can pass in and out of the openings formed between the previously noted lugs secured to the bottom of the sector frame.

The locking bar assembly, as can be seen, has a limited fore and aft motion that is determined by the length of travel of the locking piston 159 contained within the locking cylinder 112. The locking bar is adapted to insert the key between the lugs as shown in FIG. 4 when in a locking position and to withdraw the key from between the lug as as shown in FIG. 3 when in an unlocked position. As should now be evident, the locking key prevents the moldboard unit from turning when in a locking position and further translates plowing induced stresses to the stationary frame via guide plates 125—125 to protect the hydraulic drive cylinder from these potentially harmful forces. When the locking key is withdrawn from between the lugs, the moldboard unit is free to rotate about the pivot shaft. The extent of angular rotation of the unit, however, is restricted by means of end stop 90—90 carried on each of the outside lugs 87—87. The stop protrudes rearwardly behind the outer lugs a sufficient distance so that they will intercept the key when the locking bar is in the unlocked position thereby limiting the amount of travel afforded the moldboard within limits needed to achieve efficient plowing.

A hydraulic control system 99 for regulating the operation of the coacting reversible drive cylinder 102 and locking cylinder 114 is shown schematcially in FIG. 7. Hydraulic fluid is provided to the system from a hydraulic reservoir 137. A pump 138, which may be driven from any suitable source of power such as the engine of the prime mover, is arranged to draw fluid (oil) from the reservoir and raise the pressure of the fluid to a suitable level. The output of the pump is connected to a three position, four way valve 140 via supply line 141. The valve in turn is connected to drive cylinder 100 by means of service lines 145 and 146. The valve is manually controlled by an operator situated in the cab of the prime mover.

The first service line 145 connects the control valve to the forward port 110 on the drive tube 102 while a second service line 146 similarly connects the control valve to rear port 111. A pair of tees 150—150 are connected into the service lines and function to connect the line to a shuttle valve 151. The drive cylinder includes a drive piston 105 that is connected to the previously noted actuating rod 106 which can be extended or detracted to position the moldboard unit. Depending on the setting of the control valve, high pressure fluid can be brought from the pump to one sdie of the drive piston or the other to either extend or retract the rod thus allowing the operator to bring the moldboard unit to any desired position within the units of stops 90—90. The valve further functions to relieve the other side of the piston by allowing fluid displaced by the piston to be bled back to the reservoir via the return line 142.

The shuttle valve 151 contains a free floating ball 153 that is driven by the high pressure fluid into one of a pair of opposing valve seats (not shown) to effectively isolate the service line carrying high pressure fluid to the drive cylinder from that carrying low pressure fluid back to the reservoir. At the same time, the shuttle valve also allows a portion of the high pressure flow to reach the locking cylinder via feed line 155. Accordingly anytime high pressure fluid is being supplied to either side of the drive being provided to the unlocking cylinder. Feed line 155 which allows the fluid to be admitted into the cylinder behind locking piston 158. The piston rod 120 is connected directly to the piston and as explained above moves the locking bar assembly into an unlocked position when high pressure fluid is forced into the cylinder behind the piston. A biasing spring 160 is also contained in the locking cylinder of the piston and is adapted to act upon the face to urge the piston, and thus the locking bar assembly into a locked position. The spring in this case consists of a stack of Belleville washers 161—161 having a combined biasing pressure that is less than the fluid pressure delivered by the pump. Accordingly, the sector frame and the moldboard unit will be automatically unlocked anytime high pressure fluid is being fed to either side of the drive cylinder. When the control valve is manually placed in a position to isolate the pump, both cylinders are connected by the service lines and return line 142 to the reservoir thereby relieving the fluid pressure on the cylinder and allowing the locking bar assembly to return to a locked position.

Figure 6:
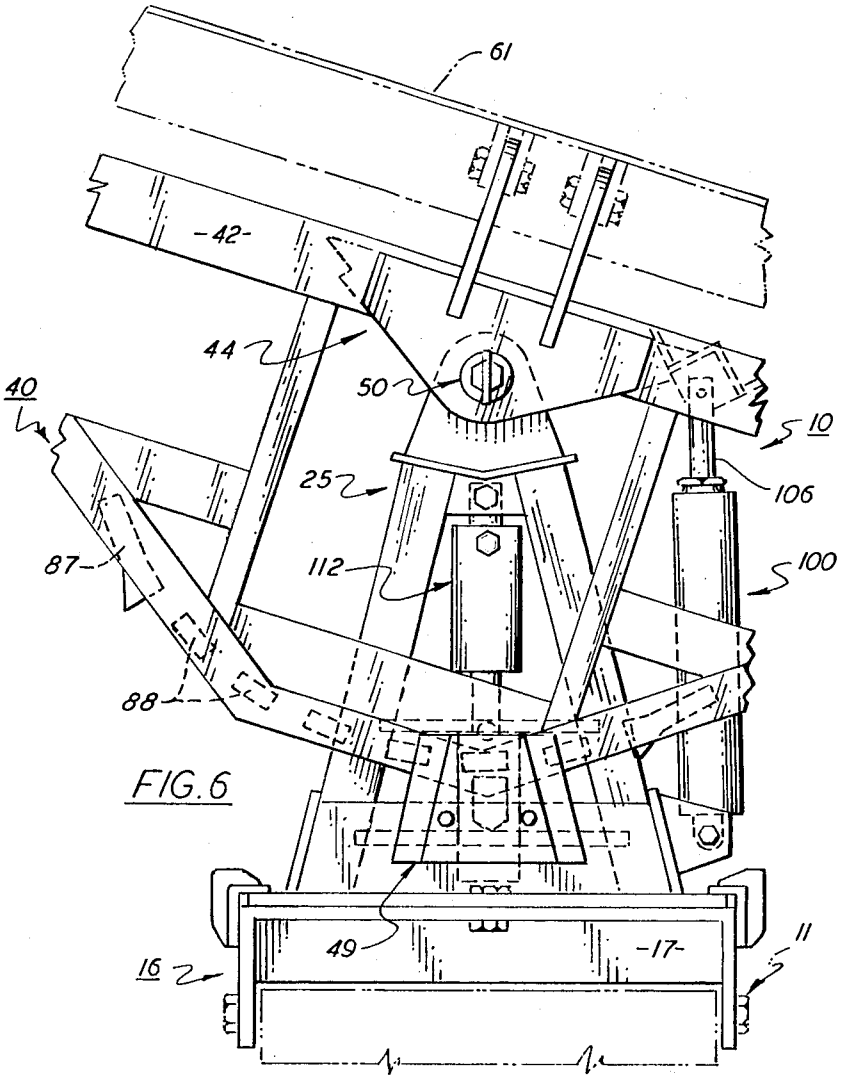
FIGS. 5 and 6 are partial top plan views of the present snowplow assembly further illustrating the moldboard unit at different angular positions.
Figure 5:
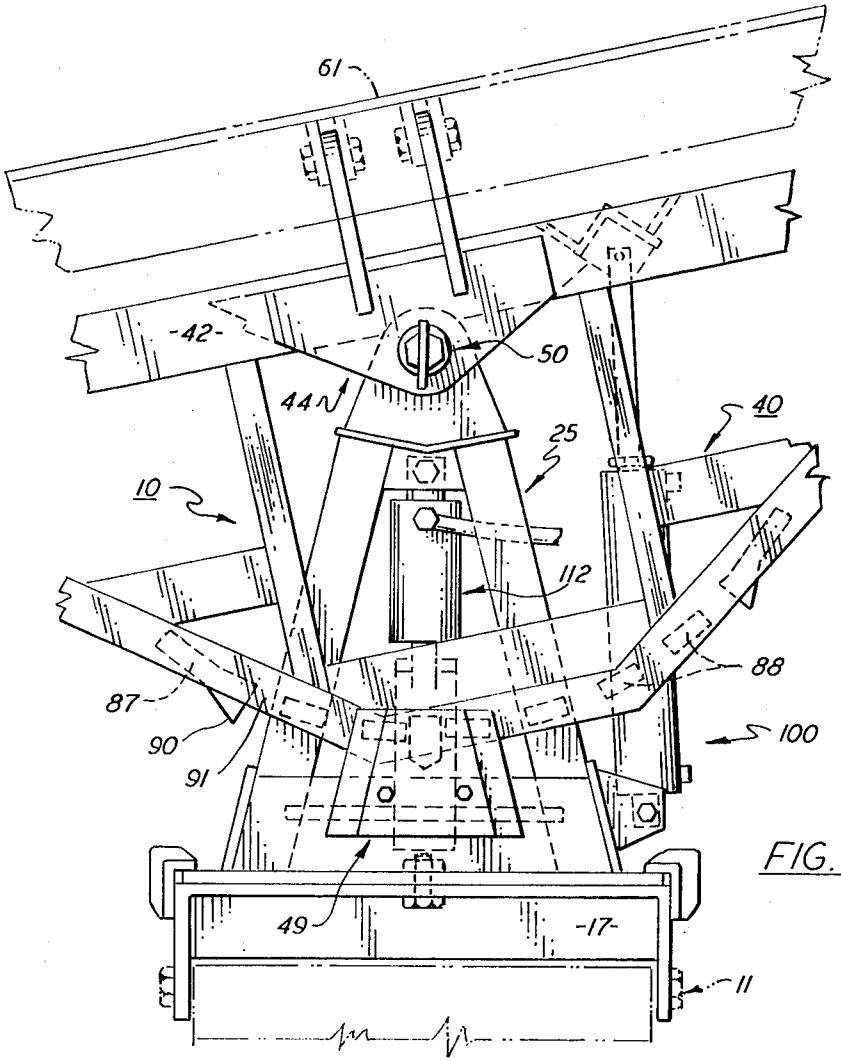

The operation of the present apparatus will be explained with further reference to FIGS. 5 and 6. In the event the operator wishes to change the position of the moldboard from that shown in FIG. 5 to that shown in FIG. 6 he positions the control valve to connect service line 145 to the pump 138. This causes high pressure to be fed into the cylinder via port 110 causing the piston rod to be retracted. At the same time high pressure fluid is delivered to the locking cylinder to move the lock bar back to an unlocked position freeing the sector frame. As the drive cylinder continues to retract the piston rod the sector frame swings through the index housing 49. When the operator deems that the plow has reached a desired position, he moves the valve to a release position thus connecting both cylinders to the fluid reservoir. Accordingly, the spring 160 is able to overcome the fluid pressure in the locking cylinder and urges the locking bar toward the locked position. If a lug opening is aligned with the bar in the indexing housing, the key will slip into the opening thus locking the moldboard unit to the support unit. If the locking bar is not aligned with an opening the operator can manipulate the valve to hunt for the nearest adjacent opening.

When the locking cylinder assembly has driven the key into a locking position, the control vavle is moved to a neutral position as shown in FIG. 7 whereupon both cylinders are permitted to bleed hydraulic fluid back to the reservoir. Accordingly, any stresses translated to the sector frame are absorbed by the locking mechanism and not the hydraulic system.

While this invention has been described hereinabove with respect to certain preferred embodiments, it is to be understood that the embodiment is certainly not limited to those precise embodiments. Instead, many modifications and variations would present themselves to those skilled in the art without departure from the scope and spirit of this invention, which is to be ascertained from the appended claims.

What is claimed is:

1. Snowplowing apparatus having a moldboard unit pivotably attached to a support unit secured to a prime mover, the apparatus including a fluid actuated drive cylinder acting between the two units for angularly positioning the moldboard unit about the pivot, valve means having at least one active position for selectively connecting the drive cylinder to a pump whereby pressurized fluid is delivered to the drive cylinder to position the moldboard unit, and a release position for connecting the drive cylinder to a fluid reservoir for relieving fluid pressure in the drive cylinder, a locking bar slidably mounted in an indexing station in said support unit for movement between a locking position wherein the locking bar is in locking engagement with the moldboard unit and an unlocked position wherein the locking bar is disengaged from the moldboard unit, spring means for biasing the locking bar into locking engagement with the moldboard unit, and a locking cylinder having a piston joined to the locking bar, said locking cylinder being responsive to the valve means to connect one side of the piston to said pump when the valve means is in the said at least one active position and to connect the same side of said piston to said reservoir when the valve means is in the release position.

2. The apparatus of claim 1 wherein said drive cylinder includes a tube housing, a drive piston slidably contained in said housing for extending and retracting a piston rod attached to one of said units, and said valve means includes a first active position for connecting one side of the drive piston to the pump to extend the rod and a second active position for connecting the other side of the drive piston to said pump to retract the rod.

3. The apparatus of claim 2 that further includes a first service line for connecting the valve means to said one side of the drive piston and a second service line for connecting the valve means to said other side of the drive piston, and a shuttle valve coupled to both service lines for routing a position of the pressurized fluid from the pump to said one side of the locking cylinder piston when the valve is in an active position and to permit pressurized fluid in the locking cylinder to return to the reservoir when the valve is in the release position.

4. The apparatus of claim 1 wherein said spring means includes a series of Belleville washers mounted in the locking cylinder and being arranged to act upon the piston to urge the locking bar into a locked position.

5. The apparatus of claim 1 wherein the moldboard unit includes a sector plate arranged to move through the indexing station and a series of lugs circumferentially spaced on the plate about the pivot to establish openings therebetween to receive the locking bar therebetween.

6. The apparatus of claim 5 wherein the axis of the locking bar passes through the center of the pivot and said openings are aligned along radial lines passing through the center of the pivot.

7. The apparatus of claim 5 that further includes a pair of end stops secured to the sector plate for engaging the locking bar when said bar is in an unlocked position to limit the angular displacement of the moldboard unit.

8. The apparatus of claim 5 that further includes guide means positioned in the indexing station for aligning the sector plate with the locking bar.

9. Apparatus for automatically positioning and locking a moldboard unit in regard to a prime mover that includes a moldboard unit movably attached to a prime mover by a vertical pivot whereby the unit may be angularly positioned about the pivot, sector means secured to the moldboard unit for movement through an indexing station, said sector means having a series of openings circumferentially spaced about the center of the pivot, a fluid actuated drive means for angularly positioning the moldboard unit, fluid control means for selectively connecting the drive means to a pump to angularly position the moldboard unit to align one of said openings in the sector means within the indexing station, and to a fluid reservior to relieve the fluid pressure on the drive means, locking means in the indexing station having a reciprocating locking bar that responds to the control means to automatically insert the bar in an opening aligned within the indexing station when the drive means is connected to the fluid reservoir and to withdraw the bar from the opening when the drive means is connected to the pump.

10. The apparatus of claim 9 wherein said locking means further includes a spring means acting upon the locking bar to urge the bar into said opening aligned within the indexing station and a fluid actuated piston attached to the bar and connected to the control means to move the bar out of the opening when the drive means is connected to the pump.

11. The apparatus of claim 9 wherein the sector means further includes a series of lugs circumferentially spaced about the sector means to establish locking bar receiving openings therebetween.

12. The apparatus of claim 9 that includes a pair of spaced end stops mounted upon the sector means for contacting the locking bar to limit the angular displacement of the moldboard.

13. Snowplowing apparatus that includes a support unit mounted upon the front of a motor vehicle having a vertically disposed pivot at the front of said support unit, a sector frame mounted upon the pivot for rotation in a horizontal plane, a moldboard unit secured to the front of the sector frame for movement therewith, said sector frame further including a plurality of lugs circumferentially spaced along a radius disposed rearwardly from said pivot to establish openings between said lugs, a hydraulic reversing cylinder secured to said support unit and having an extendable rod connected to the sector frame for angularly positioning the moldboard in said horizontal plane, a hydraulic locking cylinder secured to the support unit having an extendable locking bar that is movable between a first locking position wherein the bar is positioned in an opening between said lugs to prevent movement of said moldboard and a release position outside said opening wherein the moldboard unit can turn about said pivot, a control valve that is selectively positionable to admit fluid under pressure to said reversing cylinder to move the moldboard unit in either direction about said pivot to a desired plowing position and to relieve the fluid pressure on said cylinder when the moldboard unit is at rest in a desired position, a shuttle valve coupled to the control valve for diverting a portion of the high pressure fluid admitted to the reversing cylinder to the locking cylinder to move the locking bar into a release position anytime the moldboard unit is being rotated by said reversing cylinder, and a biasing means acting on the locking bar to drive the bar into a locking position when the pressure on the locking cylinder is relieved.

14. The apparatus of claim 13 wherein said locking bar further includes a locking key that complements the openings formed between the locking lugs to provide a close running fit therebetween.

15. The apparatus of claim 13 wherein said biasing means includes a spring acting upon the locking bar to move said locking bar into the locked position, said spring pressure being less than the fluid pressure whereby the locking bar is automatically moved to a release position when high pressure fluid is delivered to the locking cylinder.

16. The apparatus of claim 13 that further includes a pair of service lines for connecting the control valve to both sides of the power cylinder and said shuttle valve being connected between both service lines to route a portion of the high pressure fluid to the locking cylinder anytime high pressure fluid is moving in said lines toward said reversable cylinder.

* * * * *